US008134120B2

(12) United States Patent
Mueller et al.

(10) Patent No.: US 8,134,120 B2
(45) Date of Patent: Mar. 13, 2012

(54) MASS SPECTROMETER

(75) Inventors: Joerg Mueller, Buchholz (DE); Eric Wapelhorst, Hamburg (DE); Jan-Peter Hauschild, Hamburg (DE)

(73) Assignee: Bayer Technology Services GmbH, Leverkusen (DE)

( * ) Notice: Subject to any disclaimer, the term of this patent is extended or adjusted under 35 U.S.C. 154(b) by 218 days.

(21) Appl. No.: 12/526,163

(22) PCT Filed: Feb. 19, 2008

(86) PCT No.: PCT/EP2008/001287

§ 371 (c)(1),
(2), (4) Date: Aug. 6, 2009

(87) PCT Pub. No.: WO2008/101669

PCT Pub. Date: Aug. 28, 2008

(65) Prior Publication Data

US 2010/0090103 A1 Apr. 15, 2010

(30) Foreign Application Priority Data

Feb. 19, 2007 (EP) ..... 07003392

(51) Int. Cl.
*H01J 49/00* (2006.01)

(52) U.S. Cl. ..... 250/281; 250/282; 250/287; 250/290; 250/292; 250/294

(58) Field of Classification Search ..... 250/281, 250/282, 287, 288, 290, 292, 294
See application file for complete search history.

(56) References Cited

U.S. PATENT DOCUMENTS

| | | | |
|---|---|---|---|
| 5,087,815 | A | 2/1992 | Schultz et al. |
| 5,386,115 | A | 1/1995 | Freidhoff et al. |
| 5,466,932 | A | 11/1995 | Young et al. |
| 5,481,110 | A | 1/1996 | Krishnaswamy et al. |
| 5,486,697 | A | 1/1996 | Stalder |

(Continued)

FOREIGN PATENT DOCUMENTS

DE 19720278 A1 11/1998

(Continued)

OTHER PUBLICATIONS

International Search Report from the European Patent Office mailed Apr. 7, 2008.

(Continued)

*Primary Examiner* — Michael Maskell
(74) *Attorney, Agent, or Firm* — Norris McLaughlin & Marcus, PA; Christa Hildebrand, Esq.

(57) ABSTRACT

A mass spectrometer with an ionization chamber with a feed channel for a gas to be examined, including an electron source (d, n) for ionizing the gas to be examined, electrodes (c) for accelerating the ionizing electrons, electrodes (g, h, j, m) for the mass-dependent separation of the ions by acceleration/deceleration thereof, a detector (l) for the separated ions, a wiring with metallic conductors. The components are arranged on a plane nonconductive substrate (1), having an energy filter (k) for the ions, the energy filter being embodied as a 90° sector, is constructed in completely planar fashion. The ionization chamber (b), the electrodes (g, h, j, m) for accelerating the electrons and ions, the detector (l) for the ions and the energy filter (k) are produced by a single step of photolithography and etching of a doped semiconductor die (6) applied to the substrate (1) and the wiring (2) and the abovementioned parts are covered by a second flat nonconductive substrate (7).

17 Claims, 4 Drawing Sheets

U.S. PATENT DOCUMENTS

| | | | |
|---|---|---|---|
| 5,492,867 | A | 2/1996 | Kotvas et al. |
| 5,536,939 | A | 7/1996 | Freidhoff et al. |
| 7,208,729 | B2 | 4/2007 | Syms |
| 2006/0071161 | A1 | 4/2006 | Syms |

FOREIGN PATENT DOCUMENTS

| | | | |
|---|---|---|---|
| EP | 0427532 | A | 5/1991 |
| WO | 9611492 | A | 4/1996 |
| WO | 9616430 | A | 5/1996 |
| WO | 2004013890 | A | 2/2004 |

OTHER PUBLICATIONS

Yoon, H.J., et al.: "Fabrication of a novel micro time-of-flight mass spectrometer", Elsevier Science B.V., Sensors and Actuators A 97-98 (2002); pp. 441-447; ISSN 0924-4247; (Relevant p. 443; figures 1, 3).

Wapelhorst, E., et al.; "Complex MMS: a fully integrated TOF micro mass spectrometer", Elsevier Science B.V.; Science Direct Sensors and Actuators A 138 (2007); pp. 22-27.

Section AA

Section AA

Section AA

Section AA

MASS SPECTROMETER

This is an application filed under 35 USC §371 of PCT/EP2008/001287, claiming priority to EP 07003392.3 filed Feb. 19, 2007.

BACKGROUND OF THE INVENTION (1) Field of the Invention

A mass spectrometer including an ionization chamber with a feed channel for the gas to be examined, an electron source for ionizing the gas to be examined, electrodes for accelerating the ionizing electrons, electrodes for the mass-dependent separation of the ions by acceleration/deceleration thereof, a detector for the separated ions, and a wiring with metallic wires.

Mass spectrometers are used in many kinds of applications. Whereas mass spectrometers were formerly used primarily for scientific purposes, nowadays there are more and more applications in connection with protection of the environment, measurements of air quality for detecting harmful gases, process monitoring and control, security checks e.g. in airports, and the like. In particular mass spectrometers which have small dimensions and are therefore easy to transport and can be used ubiquitously are suitable for these purposes. For application on a large scale, a further requirement is that these mass spectrometers can be produced cost-effectively.

(2) Description of Related Art

Previously known mass spectrometers having a quadrupole mass separator (WO 2004/013890, GB 2384908 A) are distinguished by small size. The disadvantage is that, in the case of such quadrupole mass separators, very stringent requirements are made of the electrode geometry, with the result that a separator cannot be produced by the etching and deposition methods that are customary in microsystems engineering. Since the systems comprise a plurality of components which have to be aligned and positioned in an accurately fitting manner with respect to one another, expensive and complicated individual system processing is necessary.

In a further mass spectrometer, a magnetic field separator is used (WO 96/16430). However, the latter requires a certain minimum size since, on the one hand, very high magnetic field strengths have to be present for the magnetic field separator, while elsewhere the magnetic field has to be shielded in order not to influence the ionization or ion optics.

In a mass spectrometer produced according to microsystems engineering (YOON H J et al: "Fabrication of a novel micro time-of-flight mass spectrometer", SENSORS AND ACTUATORS A, ELSEVIER SEQUOIA S. A., LAUSANNE, C H, Vol. 97-98, 1 Apr. 2002 (Apr. 1, 2002), pages 441-447, XP004361634 (ISSN: 0924-4247), the substrate used is silicon, which has the advantage of a great variety of patterning possibilities, but has the disadvantage that large leakage currents that heat the substrate flow. A further disadvantage is the high dielectric constant, which leads to signal corruptions even if an insulating interlayer composed of silicon dioxide is used. Moreover, only a continuous acceleration in the direction of movement takes place, but not a time-variant acceleration perpendicular to the direction of movement of the ions through the electric fields, by means of which the speed-dependent selection of ions can be improved, with the result that all the ions pass to the detector and the measurement of the ion current has to be temporally resolved. In addition, the previously known mass spectrometer is not constructed in complete fashion; separator and detector are separate elements, as is shown in FIG. 11.

A further previously known miniaturized mass spectrometer (WO 96/11492) is likewise not produced in completely planar fashion by the methods of microsystems engineering; external magnets for the mass separation are provided. The corresponding disadvantages have already been mentioned above in connection with another known mass spectrometer (WO 96/16340).

A mass spectrometer of the type mentioned in the introduction was developed for use in a microsystem that can be produced by the customary methods in microsystems engineering (DE 197 20 278 A1). This mass spectrometer has only very small dimensions. However, production is very complex since, on the one hand, said mass spectrometer requires self-supporting insulated grids for the acceleration for the ionization of the gas to be examined and, on the other hand, it is necessary to produce electrically contact-connected, electrolytically grown structures composed of copper and/or nickel. The individual components are constructed separately on a total of four substrates, which have to be connected to form a monolithic system by means of suitable construction and connection technology.

BRIEF SUMMARY OF THE INVENTION

The object of the invention is to provide a mass spectrometer of the type mentioned in the introduction which can be produced simply and cost-effectively and is suitable for mass production.

The solution according to the invention consists, in the case of a mass spectrometer of the type mentioned in the introduction, in the fact

- that it is constructed in completely planar fashion
- the components are arranged on a plane nonconductive substrate,
- that it has an energy filter for the ions, said energy filter being embodied as a sector, in particular a 90° sector,
- the ionization chamber, the electrodes for accelerating the electrons and ions, the detector for the ions and the energy filter are produced by photolithography and etching of a doped semiconductor die applied to the substrate and the wiring and the abovementioned parts are covered by a second flat nonconductive substrate.

In this case, "sector" should be understood to mean an arc section on which the ions move.

The function of the mass spectrometer with the mass-dependent separation of the ions by acceleration/deceleration is based on the fact that as a result of the acceleration by the fields of the electrodes, ions that vary in heaviness attain a differing speed and the separation is effected on the basis of these speed differences. However, the corresponding ion beam allowed through is not monochromatic, it also contains ions having a larger or smaller mass which had a higher or lower starting speed on account of the thermal motion. In order to filter out these non-monochromatic ions, the energy filter is provided, in which, between two electrodes having different, in particular opposite, potentials, the ions are deflected in a channel (sector) between the electrodes. A higher accuracy is obtained by means of this measure.

In contrast to the prior art of a double-focusing mass spectrometer (WO 96/11492) the deflection by means of external magnetic fields is dispensed with here. In the case of the invention, the separation of the ions according to mass/energy is effected only by means of electric fields that are generated within the planar structure.

The particular advantage of the invention is that the mass spectrometer is constructed in completely planar fashion and can be produced from wafers using the techniques in microelectronics. The components are arranged on a plane nonconductive substrate, on which the metallic connection wiring has initially been applied. The ionization chamber, the electrodes for accelerating the electrons and ions, the detector for the ions and the energy filter are produced by photolithography and etching of a semiconductor die applied to the substrate and the wiring, wherein all the components are produced in one photolithographic and etching step. Afterward, the components are then covered by a flat nonconductive substrate in order thus to obtain a closed unit.

In one advantageous embodiment, the electron source is a thermal emitter. In another advantageous embodiment, the electron source has a plasma chamber with a feed channel for a noble gas and with a microwave line for introducing microwaves for generating and maintaining the plasma, wherein the plasma chamber, the feed channel and the microwave line are likewise produced by etching of the semiconductor die together with the other parts.

In one advantageous embodiment, the electrodes for the mass-dependent separation of the ions by acceleration/deceleration are embodied and arranged as a time-of-flight mass separator. The ion beam is pulsed in a first gate electrode arrangement. In this way, only short ion pulses pass into the drift path, where the pulse diverges on account of the different speeds of the ions. The ion pulse is sampled at a second gate electrode arrangement. In this case, different propagation times correspond to different masses. The energy filter then ensures that only ions having precisely one energy reach the detector and are registered there.

In a traveling field separator, in the measurement section a relatively large number of electrodes are provided to which electrical (AC) voltages are applied which "travel" from one end to the other end with the ions. Only the ions having precisely the speed that corresponds to the "traveling speed" of the electric fields always move through electrodes to which no voltage is being applied. All the other ions, which are out of step, move between electrodes to which an electrical voltage is being applied, with the result that they are deflected to the side.

The detector for the ions is advantageously embodied as a Faraday detector. In another advantageous embodiment, which has greater sensitivity, the detector for the ions is embodied as an electron multiplier.

The electrodes for accelerating the electrons can be two electrodes which are provided with screen openings and to which different electrical potentials can be applied. These electrodes can likewise be produced from the semiconductor material, with the result that the previously known grid arrangement for accelerating the electrons in the prior art (DE 197 20 278 A), which is difficult to produce, is avoided.

The mass spectrometer advantageously has a microcontroller, by means of which said mass spectrometer is controlled.

The metallic conductors of the wiring and the electrodes are advantageously electrically connected by eutectic semiconductor-metal contacts. For this purpose, bumps composed of a suitable metal are arranged on the wires or conductor tracks on the corresponding locations, said bumps forming the eutectic semiconductor-metal contacts in the course of bonding with the semiconductor die.

A particular advantageous metal for the eutectic contacts is gold.

The non-conductive substrates are advantageously composed of borosilicate glass or quartz glass.

The invention is also distinguished by a method for producing the mass spectrometer. In accordance with these methods, the metallic wiring is applied to a flat nonconductive substrate, metal pads for connection to the semiconductor electrodes being arranged on said wiring. Depressions corresponding to the wiring are then etched into the semiconductor die in order that the semiconductor material comes into contact only with the metal pads but not with the wiring during bonding. Afterward, the semiconductor die is then applied to the substrate and a mask for photolithography is arranged onto the same. In this case, the alignment of the mask with respect to the wiring and gold pads can be effected optically by using light having a wavelength for which the silicon die is transparent. For silicon, a wavelength above 1.2 μm is suitable in this case. After corresponding exposure and removal of the mask, the semiconductor die is then etched locally in one step, in order to produce the components of the mass spectrometer. The semiconductor die is subsequently covered with a second nonconductive substrate.

In this case, a further wiring can be applied to the second nonconductive substrate beforehand in order e.g. to connect electrodes of electrode pairs to one another.

The invention is described below on the basis of advantageous embodiments with reference to the accompany drawings, in which:

DETAILED DESCRIPTION OF THE INVENTION

Figure 1:
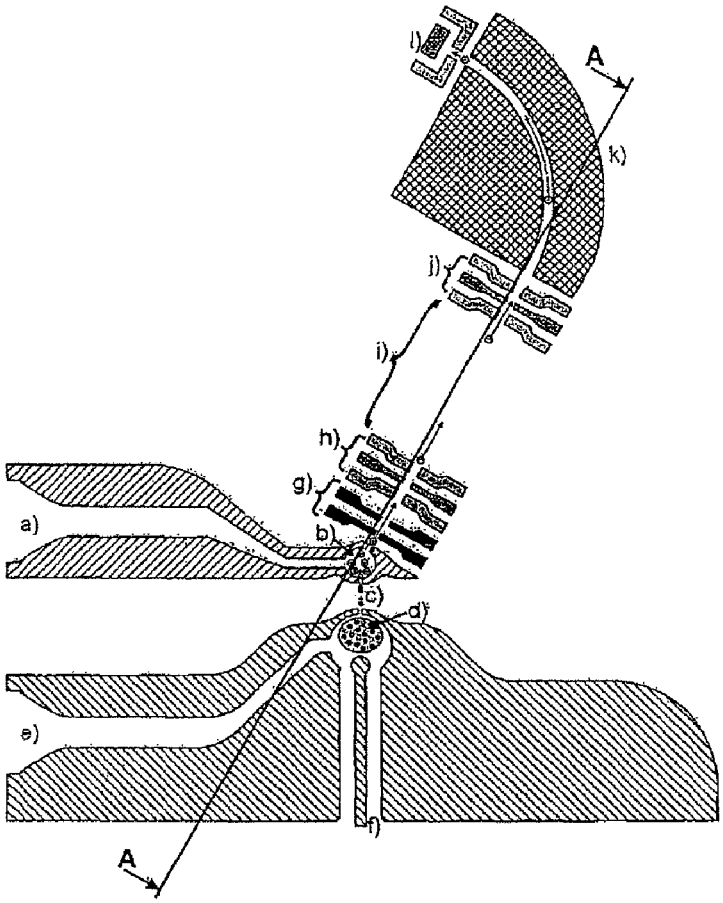
FIG. 1 shows the basic arrangement of the essential parts of an advantageous embodiment of the mass spectrometer without wiring and non conductive substrates.

FIG. 1 shows the finished semiconductor die, which is composed of doped silicon in this embodiment and in which the corresponding components are produced by etching. The spectrometer has a feed channel a for the sample gas that is conducted into the ionization chamber b. The electrons having an energy of typically 70 eV which are required for the ionization are extracted from a plasma chamber d and accelerated between two screen openings c, which are at different potentials. The entire region between the screen openings is evacuated toward the sides of the system. The noble gas is fed to the plasma chamber d via the channel e. It is excited with microwaves via the microwave conductor f in order to generate the plasma and thereby liberate the electrons required. Pressure in the plasma chamber is controlled by means of the inlet pressure upstream of the channel e or a connected capillary.

The ions from the ionization chamber b are extracted by an electric field between chamber wall and ion optics g to a further screen opening, and with a defined energy are accelerated and focused. The ion beam is pulsed at the first gate electronic arrangement h. Consequently, only short ion pulses pass into the drift path i, where the pulse diverges on account of the different speeds of the ions. The ion pulse is sampled at the second money electrode arrangement j. The energy filter k ensures that ions only having precisely one energy reach the detector l and are registered there.

Figure 2:
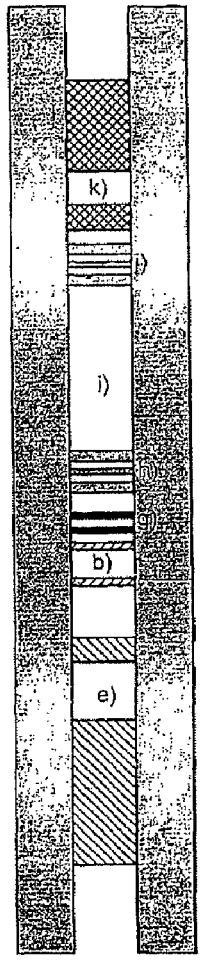
FIG. 2 shows a section along the line A-A from FIG. 1, the nonconductive substrates being concomitantly illustrated.
Figure 3:
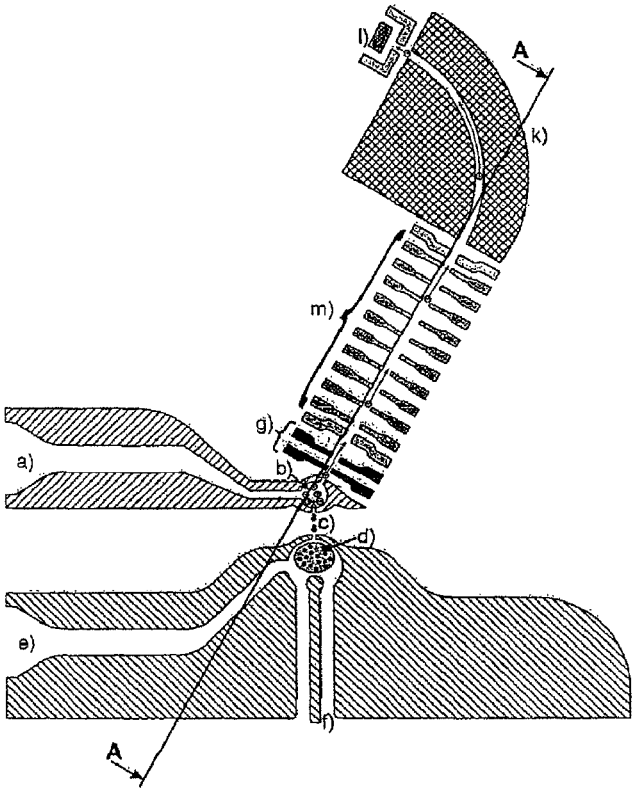
FIG. 3 shows another embodiment, in an illustration similar to FIG. 1.
Figure 4:
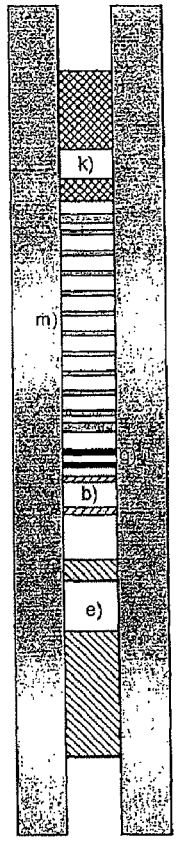
FIG. 4 shows a section corresponding to the line A-A from FIG. 3, in an illustration similar to FIG. 2.

FIGS. 3 and 4 show another embodiment, which differs from the embodiment in FIGS. 1 and 2 in the region of the accelerating electrodes. An AC voltage is applied to the electrodes m of the traveling field separator, with the result that ions moving through between electrodes to which a voltage is being applied are deflected to the side and removed from the beam. Only the ions having precisely the correct speed which in each case pass through the electrodes when there is no voltage present at the latter reach the energy filter k, the two electrodes of which on both sides of the quadrant-shaped channel are at opposite potentials, in order thus to allow through only ions having a precisely defined energy. These ions then again impinge on the detector l.

Figure 5:
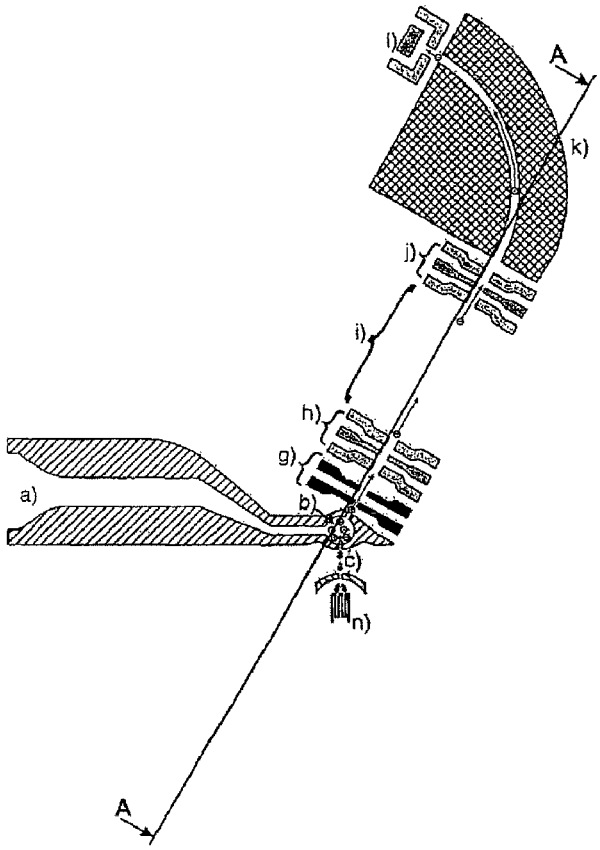
FIG. 5 and FIG. 6 show illustrations of a third embodiment corresponding to FIGS. 1 and 2, and FIGS. 3 and 4.
Figure 6:
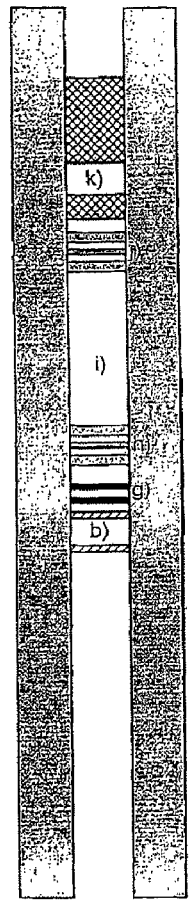

The embodiment in FIGS. 5 and 6 differs from that in FIGS. 1 and 2 in that, instead of a noble gas plasma, a thermal emitter n is used for liberating the electrons required for the ionization.

Figure 7:
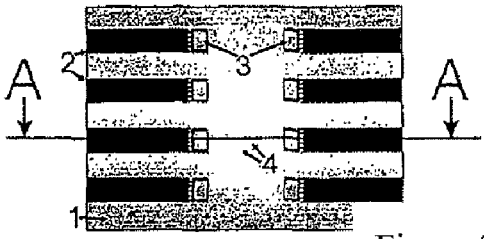
FIG. 7 shows a plan view of the accelerating electrode arrangement.
Figure 8:
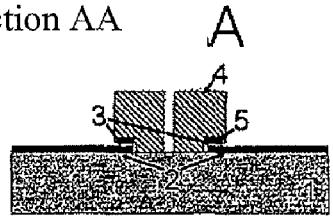
FIG. 8 shows a section along the line A-A from FIG. 7.

FIGS. 7 and 8 show the electrode region of the mass spectrometer according to the invention. The borosilicate glass 1 serves as a carrier for the system, metallic conductor tracks 2 being applied to said borosilicate glass in order to electrically interconnect the electrodes. The electrical contact between the metallic conductor tracks 2 and the silicon electrodes 4 is effected by means of a eutectic gold-silicon contact 5. Gold pads 3 at the contact locations between conductor track 2 and silicon electrode 4 alloy in the course of bonding with the highly doped silicon and thus produce an ohmic contact. In this case, the construction of the electrodes is shown in section in FIG. 8.

Figure 9:
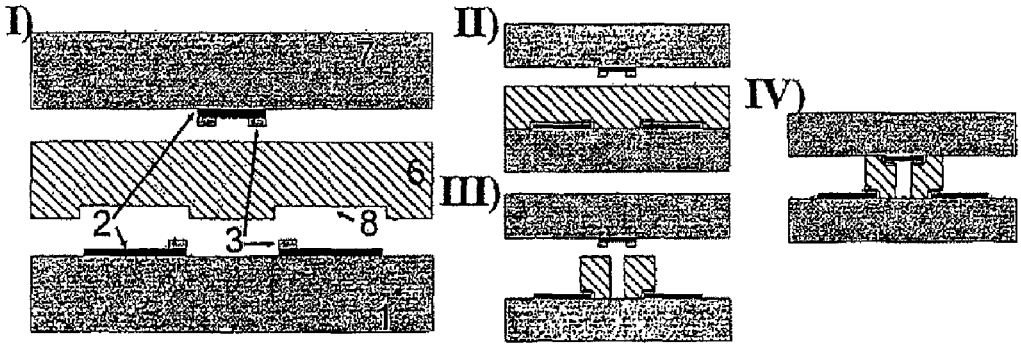
FIG. 9 shows the principle of the production of the mass spectrometer of the invention.

FIG. 9 shows the principle of the production of the mass spectrometer. Cutouts 8 are produced by means of an etching in the silicon die, said cutouts providing for the required distance between the metallic conductor tracks 2 on the carrier substrate 1 and the silicon die 6 in the finished mass spectrometer. This is necessary in order that the substrate 1 and the silicon die 6 can be bonded in planar fashion. In this case, the depth of the etching pits 8 is designed such that the gold pads 3 come into contact with the bottom of the etching pit 8 when substrate 1 and silicon die 6 are joined together. The arrangement thus produced in accordance with I is then bonded in step II. In step III, the desired structure is produced after application of a corresponding mask and exposure by etching. The upper substrate 7 shown in I, II and III is in reality not yet present during these steps. It likewise bears a conductor and is then bonded onto the arrangement during IV, wherein electrodes are connected by the conductor arranged on the upper substrate 7.

The production of the mass spectrometer can be effected in uniform steps in wafers. The finished mass spectrometer shown in the figures can have dimensions of as small as 5×10 mm. On account of the small size, the requirements made of the pump capacity of a vacuum pump are only low as well.

The invention claimed is:

1. A mass spectrometer comprising:

an ionization chamber (b) with a feed channel (a) for a gas to be examined, an electron source (d, n) for ionizing the gas to be examined, first electrodes (c) for accelerating the ionizing electrons, a plurality of second electrodes (g, h, j, m) for mass-dependent separation of ions by acceleration/deceleration thereof, a detector (l) for detecting the separated ions, and a wiring with metallic conductors, wherein the ionization chamber (b), the electron source (d,n), the first electrodes (c), the plurality of second electrodes (g,h,j,m), the detector (l) and the wiring are arranged on a plane nonconductive substrate (1), the mass spectrometer has an energy filter (k) for the ions, said energy filter being embodied as a 90° sector, wherein the mass spectrometer is constructed in completely planar fashion, wherein the ionization chamber (b), the plurality of second electrodes (g, h, j, m) for accelerating the electrons and ions, the detector (l) for the ions and the energy filter (k) are produced by a single step of photolithography and etching of a doped semiconductor die (6) applied to a substrate (1) and wiring (2) and wherein the ionization chamber (b), the plurality of second electrodes (g, h, j, m), the detector (l) for the ions and the energy filter (k) are covered by a second flat nonconductive substrate (7).

2. The mass spectrometer as claimed in claim 1, wherein the electron source (n) is a thermal emitter.

3. The mass spectrometer as claimed in claim 1, wherein the electron source has a plasma chamber (d) with a feed channel (e) for a noble gas and with a microwave line (f) for introducing microwaves for generating and maintaining the plasma, wherein the plasma chamber (d), the feed channel (e) and the microwave line (f) are produced by etching of the semiconductor die (6).

4. The mass spectrometer as claimed in claim 1, wherein the plurality of second electrodes (g, h, j) for the mass-dependent separation of ions by acceleration/deceleration are embodied and arranged as a time-of-flight mass separator.

5. The mass spectrometer as claimed in claim 1, wherein the electrodes (g, m) for the mass-dependent separation of irons by acceleration/deceleration are embodied and arranged as travelling-wave separator.

6. The mass spectrometer as claimed in claim 1, wherein the detector (l) for the ions is embodied as a Faraday detector.

7. The mass spectrometer as claimed in claim 1, wherein the detector (l) for the ions is embodied as an electron multiplier.

8. The mass spectrometer as claimed in claim 1, wherein the first electrodes (c) for accelerating the electrons are two electrodes which are provided with screen openings and to which different electrical potentials can be applied.

9. The mass spectrometer as claimed in any of claim 1, wherein the mass spectrometer has a microcontroller.

10. The mass spectrometer as claimed in claim 1, wherein the metallic conductors (2) and the electrodes (4) are electrically connected by eutectic metal-semiconductor contacts.

11. The mass spectrometer as claimed in claim 1, wherein the metallic conductors (2) and the electrodes (4) are electrically connected by eutectic gold-semiconductor contacts.

12. The mass spectrometer as claimed in claim 1, wherein the semiconductor material is doped silicon.

13. The mass spectrometer as claimed in claim 1, wherein the nonconductive substrates (1, 7) are composed of borosilicate glass or quartz glass.

14. A method for producing a mass spectrometer, comprising the steps of providing an ionization chamber for a gas to be examined with a feed channel for the gas, providing an electron source for electrons that ionize the gas, providing first electrodes for accelerating the electrons, providing a plurality of second electrodes for focusing and accelerating ions emerging from the ionization chamber and for the mass-dependent separation of said ions by acceleration/deceleration, providing a detector for the ions, connecting with metallic wiring conductors the ionization chamber, the electron source, the first electrodes, the plurality of second electrodes, providing an energy filter for the ions, said energy filter being embodied as a sector, wherein the metallic wiring conductors are applied to a flat nonconductive substrate, and wherein metal pads for connection to the semiconductor electrodes are being arranged on said wiring, etching depressions corresponding to the wiring into the semiconductor die, applying the semiconductor die to the substrate, aligning a mask for photolithography optically using light having a wavelength of above approximately 1.2 μm on the semiconductor die, subsequently etching locally, and covering the semiconductor die with a flat second nonconductive substrate.

15. The method as claimed in claim 14, wherein wiring is applied with the second nonconductive substrate.

16. The method as claimed in claim 14, wherein doped silicon is used as semiconductor material.

17. The method as claimed in claim 14, wherein gold is used as the metal for the metal pads.

* * * * *